US008898984B2

(12) United States Patent
Winteler

(10) Patent No.: US 8,898,984 B2
(45) Date of Patent: Dec. 2, 2014

(54) FAÇADE INSULATION

(75) Inventor: Hans Winteler, Mels (CH)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 13/551,108

(22) Filed: Jul. 17, 2012

(65) Prior Publication Data

US 2012/0279156 A1 Nov. 8, 2012

Related U.S. Application Data

(63) Continuation of application No. PCT/CH2011/000004, filed on Jan. 18, 2011.

(30) Foreign Application Priority Data

Jan. 18, 2010 (CH) ..... 61/10

(51) Int. Cl.

| | |
|---|---|
| ***E04B 2/06*** | (2006.01) |
| ***E04F 13/08*** | (2006.01) |
| ***E04F 13/04*** | (2006.01) |
| ***E04B 1/76*** | (2006.01) |
| *E04B 2/16* | (2006.01) |
| *E04F 13/07* | (2006.01) |

(52) U.S. Cl.

CPC ..... *E04F 13/0807* (2013.01); *E04F 13/045* (2013.01); *E04B 1/7629* (2013.01); *E04B 2/16* (2013.01); *E04F 13/07* (2013.01); *E04B 2/06* (2013.01); *E04B 1/762* (2013.01)

USPC ..... 52/506.06; 52/404.1; 52/407.4; 52/405.1; 52/513; 52/512

(58) Field of Classification Search

CPC ..... E04B 2/06; E04B 2/16; E04B 2/72; E04B 2/721; E04B 2/74; E04F 13/07; E04F 13/072; E04F 13/21

USPC ..... 52/407.4, 407.5, 405.1, 405.2, 404.1, 52/405.3, 407.2, 404.2, 404.3, 404.4, 52/404.5, 506.06, 506.01, 506.05, 511, 52/513, 543, 549

See application file for complete search history.

(56) References Cited

U.S. PATENT DOCUMENTS

| | | | | |
|---|---|---|---|---|
| 3,353,312 | A * | 11/1967 | Storch | 52/713 |
| 3,964,227 | A * | 6/1976 | Hala | 52/568 |

(Continued)

FOREIGN PATENT DOCUMENTS

| | | | | |
|---|---|---|---|---|
| DE | 22 01 621 | A1 | 7/1973 | |
| DE | 28 49 727 | A1 | 5/1980 | |
| DE | 32 13 899 | A1 | 10/1983 | |
| DE | 3407867 | A1 * | 9/1985 | E04B 2/00 |
| DE | 91 04 712 | U1 | 6/1991 | |
| DE | 94 13 214.3 | U1 | 10/1994 | |
| DE | 203 15 878 | U1 | 11/2004 | |
| EP | 0 026 495 | A2 | 4/1981 | |
| FR | 2554845 | A1 * | 5/1985 | E04B 1/76 |

OTHER PUBLICATIONS

International Search Report mailed Apr. 7, 2011 issued in a corresponding PCT International Application No. PCT/CH2011/000004, filed Jan. 18, 2011 (3 pages).

*Primary Examiner* — Phi A

(74) *Attorney, Agent, or Firm* — Robert P. Michal; Lucas & Mercanti, LLP

(57) ABSTRACT

Façade insulation with at least one support rail which is arranged on an outer wall of a building, and with a multiplicity of heat insulation panels which are supported by the support rail. The support rail is spaced from the outer wall by at least two spacers. To transfer the weight of the heat insulation panel to the outer wall, at least two tension brackets are provided which can each be fixed with a first end to the support rail and with a second end to the outer wall. A mounting kit holds heat insulation panels on an outer wall of a building. The mounting kit includes at least one support rail, at least two spacers, at least two tension brackets and at least one wall fixing element.

19 Claims, 2 Drawing Sheets

(56) References Cited

U.S. PATENT DOCUMENTS

Figure 1:
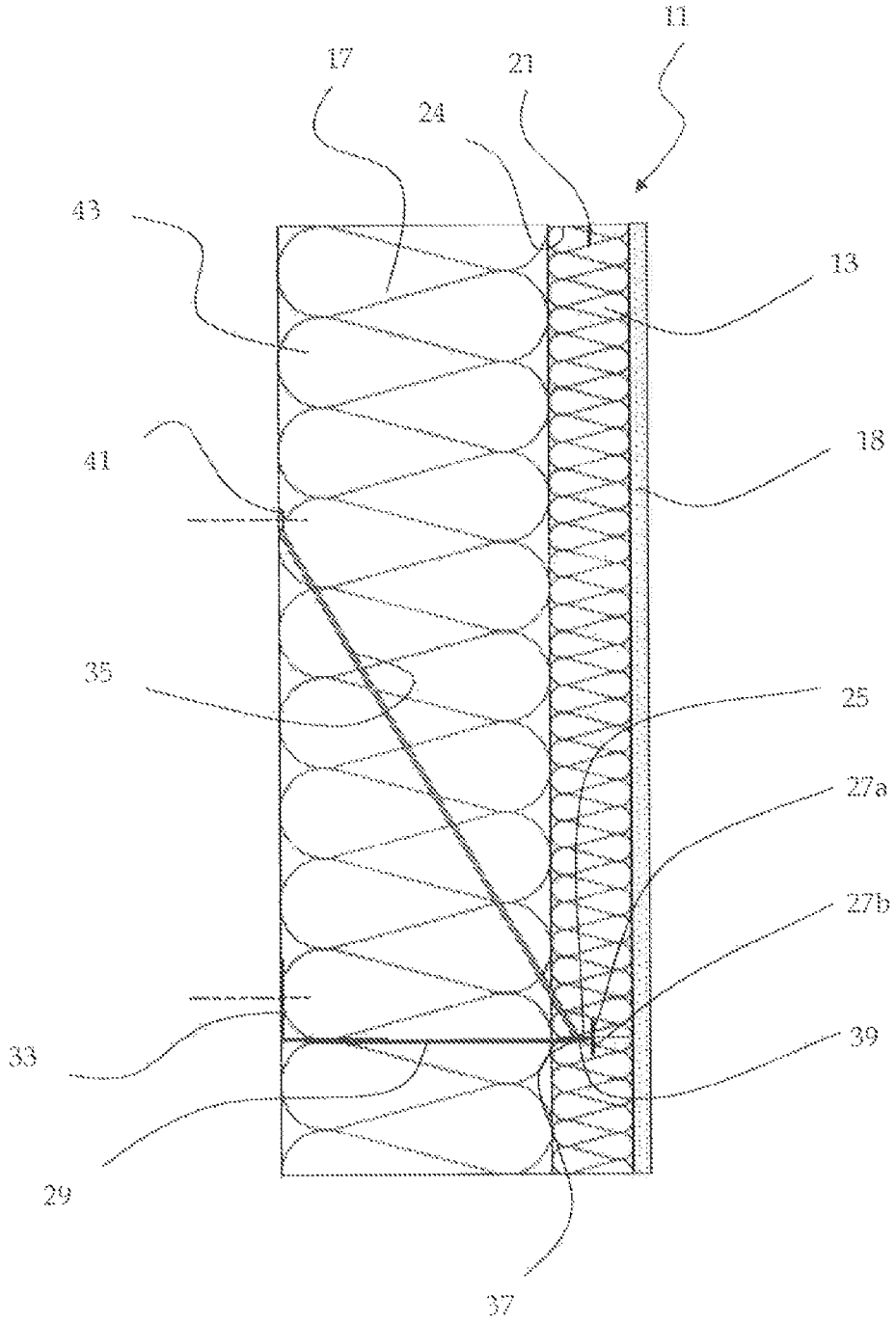

| | | | | | |
|---|---|---|---|---|---|
| 4,495,741 | A * | 1/1985 | Pasiecznik | 52/404.1 |
| 4,545,163 | A * | 10/1985 | Asselin | 52/378 |
| 5,657,593 | A * | 8/1997 | Eriksen | 52/235 |
| 5,709,058 | A * | 1/1998 | Shaw | 52/404.1 |
| 5,987,830 | A * | 11/1999 | Worley | 52/309.11 |
| 6,131,360 | A * | 10/2000 | Dalen | 52/712 |
| 6,351,918 | B1 * | 3/2002 | Westra et al. | 52/404.2 |
| 7,059,577 | B1 * | 6/2006 | Burgett | 249/40 |
| 2006/0240725 | A1 * | 10/2006 | Dragotta | 442/43 |

* cited by examiner

FAÇADE INSULATION

CROSS-REFERENCE TO RELATED APPLICATIONS

This is a Continuation of PCT International Application No. PCT/CH2011/000004, filed Jan. 18, 2011, which claims the benefit of Swiss Patent Application No. CH 61/10, filed Jan. 18, 2010, the entire disclosure of each of which is incorporated herein by reference.

FIELD OF INVENTION

The invention is directed to façade insulation, a mounting kit to hold heat insulating panels, and a façade insulation system.

PRIOR ART

For energy-saving reasons, the building industry is obliged to make heat insulation panels for building insulation ever thicker. Also it is expected that heat insulation panels can be rendered directly with a mesh-reinforced plaster, which requires a high density on their outside. However there are limits to this development as the weight of such heat insulation panels increases. This consequently affects the cost of the heat insulation panels and the fixing complexity. Therefore the first requirement is opposed by the requirement to make heat insulation panels as light as possible. Heat insulation panels are bonded and pegged to building outer walls as standard. To fix heat insulation panels with greater weight, a consequently higher number of pegs is required to attach the heat insulating panels reliably. This type of fixing is therefore cost intensive.

DE 9413214 discloses a device for fixing heat insulation panels to a building outer wall. The device concerns a retaining rail in the form of an angle profile. A first leg of this angle profile serves to fasten the supporting rail to the building outer wall. The second leg which stands at a right angle to the first leg runs into a retaining web which extends approximately parallel to the first leg. On mounting, the heat insulation panels previously fitted with a groove are pushed onto the retaining web. The benefit of these retaining rails is that the use of pegs may be omitted. The rails can however only hold relatively thin heat insulation panels of high density. The high density is essential for formation of the groove and support of the load in the region of the grooves.

DE 28 49 727 discloses a height-adjustable clinker holder. The holder has an anchor web which at one end is adjustably connected with a support bracket to move via a hinge. At the other end the anchor web is connected height-adjustably with a shear connector and held in the supporting wall by the shear connector. The support bracket is supported on the supporting wall by means of an adjustable supporting bolt. It is evident that the suspended clinker or tile wall held in front of the supporting wall by the clinker trap and spaced from this has a high weight. The clinker holder must therefore be designed correspondingly solid in order to be able to carry the suspended wall. In addition the clinker or tiled wall is connected with the supporting wall by wire or peg anchors. The hinged connection between the support bracket and the anchor web is relatively complex to produce. It is not disclosed how heat insulation panels which are relatively light in comparison with a suspended wall, can be held by the clinker holder.

DE 32 13 899 discloses a device for suspending precast concrete elements at a specific distance from building shells. The fixings are already firmly installed in this building shell and in the precast concrete part during production. A suspension tension anchor is suspended on one side in a suspension shoe integrated into the building shell. At its other end the suspension tension anchor is held vertically mobile in an anchor rail. The anchor rail is cast into the precast concrete part. A stud bolt which is screwed into a threaded sleeve welded to the anchor rail serves for displacement of the suspension tension anchor along the anchor rail. This suspension method is suitable for holding very heavy parts such as precast concrete parts. For heat insulation panels however this suspension method is unsuitable as the anchor rails are only held inadequately in a heat insulation panel and tend to tear out.

EP 0 026 495 discloses a wall holding profile set for fixing to a substructure for back-ventilated façade panels. A vertically oriented façade holder is arranged in front of a wall and extends transverse to the longitudinal extent of the façade panels. The vertically oriented façade holder is spaced from the wall by a spacer. A first wall holding profile which connects the spacer with the wall serves as a fixing point. A second wall holding profile with slots, which is also connected with the spacer and arranged above the first wall holding profile, serves as a sliding point. To prevent a sideways shift to the right or left, the façade holder is also held away from the wall by holding blocks. No horizontal façade retention is provided in this wall profile set, therefore the façade panels must be held on the façade holder with additional fixing means such as rivets or screws. For rapid mounting of heat insulation panels however a horizontal supporting holder is always required. This holding profile set cannot therefore be used for fixing heat insulation panels to walls.

OBJECT OF THE INVENTION

An object of the present invention is to provide a façade insulation which takes account of the increased requirements for external heat insulation and allows economic and rapid fixing of heat insulation panels.

DESCRIPTION

According to the invention the object is achieved with façade insulation according to the preamble of claim 1 in that a multiplicity of second heat insulation panels is supported by the support rail and spaced from the outer wall of a building, wherein between the inside of the second heat insulation panel and the outer wall is formed a cavity which receives the multiplicity of heat insulation panels.

The façade insulation according to the invention has the advantage that first and second heat insulation panels of different wall thicknesses and densities can be arranged very easily and consequently quickly on the outer wall. The façade insulation can nonetheless be adapted flexibly to the respective insulation requirements by selection of corresponding first and second heat insulation panels. Also heat insulation panels of great thickness and increased weight can be held reliably on a building outer wall. The different thicknesses of the heat insulation panels can be taken into account by different spacer lengths. The tension brackets prevent flexion of the spacers under the weight of the insulation panels. It would also be conceivable that instead of the tension bracket, compression brackets are used which are arranged below the support rail.

The cavity serves for additional heat insulation. The first inner heat insulation panel is expediently held in the cavity. It would also be conceivable for the cavity to be filled with bulk heat insulation material. In this case the cavity is closed at its lowest point so that the bulk product cannot fall out of the cavity. By the combination of heat insulation panels of different densities and thicknesses, an optimum heat insulation is achieved which has a low thermal conductivity for relatively low weight.

It has proved advantageous if the heat insulation panel has a density whose upper value is 190 kg/m$^3$, preferably 170 and particularly preferably 150 kg/m$^3$, and whose lower value is 100 kg/m$^3$, preferably 110 kg/m$^3$ and particularly preferably 120 kg/m$^3$, and faces away from the outer wall, and the inner heat insulation panel has a density whose upper value is 90 kg/m$^3$, preferably 70 and in particular preferably 65 kg/m$^3$, and whose lower value is 20 kg/m$^3$, preferably 30 kg/m$^3$ and particularly preferably 55 kg/m$^3$. The different densities of the two layers lead to very good thermal insulation values with relatively low weights and thicknesses of the heat insulation panels.

In a preferred exemplary embodiment the first inner heat insulation panel has a greater thickness than the second heat insulation panel, wherein the thickness of the first heat insulation panel is preferably at least 1.5 times the thickness of the second heat insulation panel. With the selected parameters of density and thickness of the first and second heat insulation panels, the façade insulation according to the invention can be adapted optimally to the required heat insulation requirements.

It has proved advantageous if the first heat insulation panel is supported by the at least one spacer. No additional fixing is therefore required to hold the first heat insulation panel as the spacer is present in any case to space the second heat insulation panel from the outer wall. When mounting the façade insulation, the first heat insulation panel is then merely placed on the spacer with no further fixing means required.

Expediently the support rail has a web facing the outer wall and attached to the first end of the spacer. The spacers can easily be attached to the web through the open construction.

It has proved advantageous if retaining extensions are provided on both sides of the web on which the heat insulation panels are held by form fit. The retaining extensions can be produced economically by profile production and guarantee secure retention of the heat insulation panels. It would also be conceivable for a retaining extension to be formed only on one side of the web. This is sensible in particular for support rails which are at the very top or very bottom on the outer wall. As the weight of the heat insulation panels of the first layer is transferred to the support rail, no shear forces act within the second layer. The second layer can therefore, as already described above, be designed extremely light weight.

In a particularly preferred embodiment along the periphery of each heat insulation panel are provided grooves which serve to receive the retaining extensions of the support rails. Because the heat insulation panels also have grooves in the vertical direction in mounted state, adjacent heat insulation panels are aligned to each other all round. This leads to a flat surface over the entire area of the façade insulation which can be rendered easily.

In a further preferred embodiment a multiplicity of passage openings is provided at regular intervals on the web. The tension brackets can therefore be positioned very easily in the vertical separating joints of adjacent heat insulation panels.

For rapid fixing of the tension brackets to the support rails, these are suspended with their first ends on the support rails.

Advantageously the tension brackets are arranged in the vertical separating joints between two adjacent heat insulation panels. The heat insulation panels can therefore be installed quickly and need not be adapted to the tension brackets since the brackets are arranged in the separating joints which are present in any case.

In order to allow the use of spacers of different lengths, the spacers are fixed at their second end to the outer wall with at least one fixing element. The fixing element can for example be an angle bracket on which a single spacer is fixed, or an angle rail can be used on which a multiplicity of spacers is fixed.

In a further particularly preferred embodiment, slots which extend perpendicular to the outer wall are provided on the spacers at a short distance from the second ends, in the web of the support rail, or at the fixing element. The slots allow the support rails fixed to the spacers to be displaceable in the direction towards the outer wall or away from the outer wall. The retaining extensions can therefore be adjusted precisely below the grooves.

A further aspect of the invention concerns a mounting kit according to claim 14. Advantageously the kit comprises, as well as a mounting rail, also at least two spacers, at least two tension brackets and at least two wall fixing elements. With this mounting kit, all heat insulation panels available on the market can be attached to a building outer wall irrespective of their weight or thickness, provided that grooves are fitted on their side faces.

According to a further aspect of the invention a façade insulation system advantageously comprises a heat insulation panel of high density, in which a groove is formed in at least two opposing side faces and preferably in all four sides, an inner heat insulation panel which is arranged between an outer wall of a building and the heat insulation panel, and a mounting kit to hold the heat insulation panel on an outer wall of a building with at least two support rails to be arranged in the grooves, at least one spacer per support rail and at least two tension brackets to suspend the lower support rail on the outer wall.

The invention is explained below in more detail with reference to the figures in diagrammatic depiction. These show:

FIG. 1 a side view of a façade insulation according to the invention, and

Figure 2:
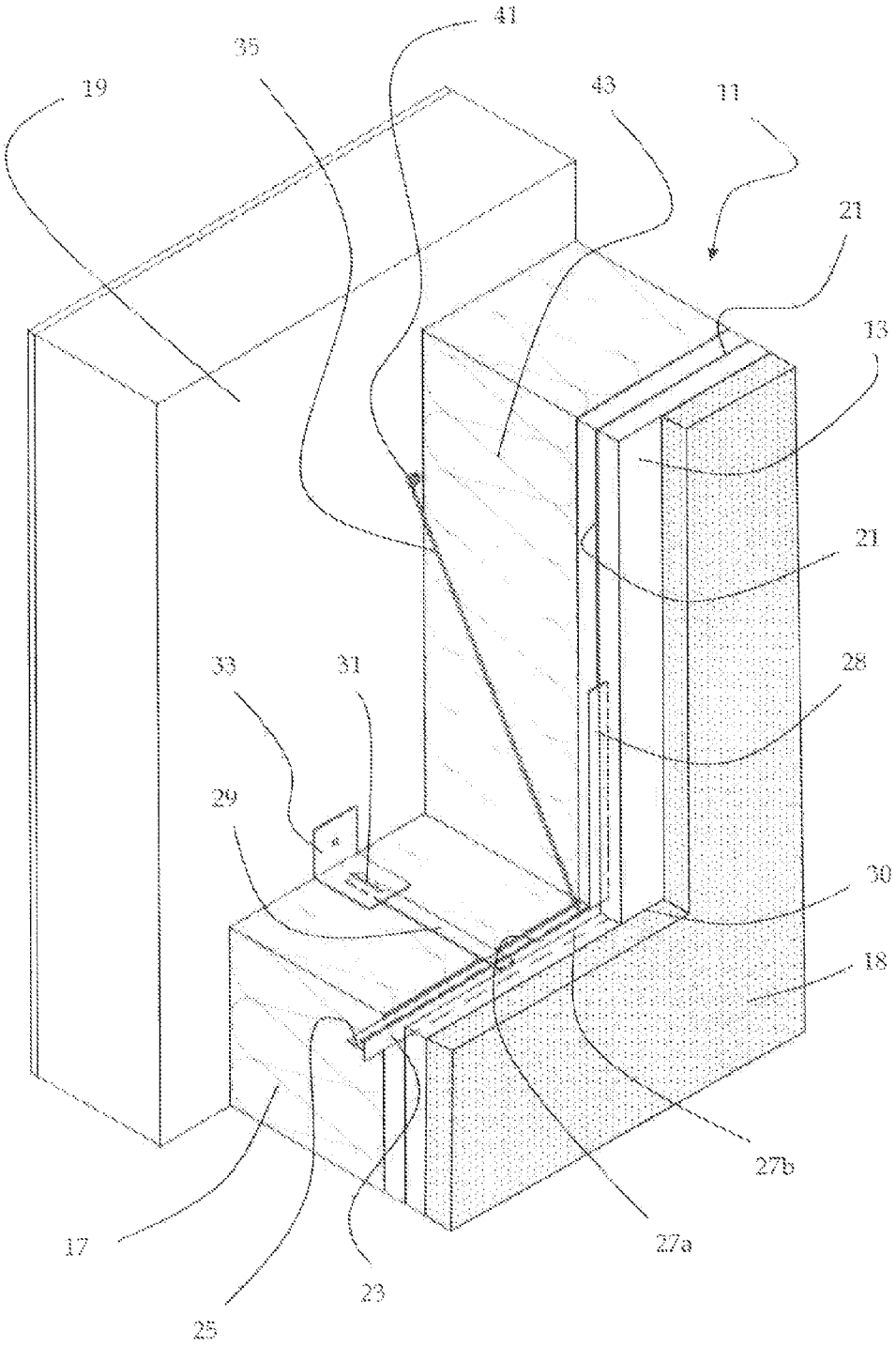

FIG. 2 a perspective view of the façade insulation of FIG. 1.

FIGS. 1 and 2 show a façade insulation according to the invention which is designated as a whole with reference numeral 11. An individual heat insulation panel 13 preferably has a standard size of 600×1000 mm, although any other insulation panel dimensions are also possible. In the cavity provided between the heat insulation panel 13 and an outer wall 19 of a building is arranged an inner heat insulation panel 17. The inner heat insulation panel 17 preferably has the same standard dimensions as the heat insulation panel 13 and terminates flush with this. The density of the inner heat insulation panel 17 is preferably 60 kg/m$^3$, whereas the density of the heat insulation panel 13 is preferably 120 kg/m$^3$. The insulation panels are preferably made of mineral fibres, however other insulation materials can be used. The combination of heat insulation panels of different densities allows an improved heat insulation with low weight. The lighter inner heat insulation panel 17 faces the outer wall 19 of a building, the denser heat insulation panel 13 is spaced from the outer wall 19. This allows in total a low volume weight with correspondingly high insulation capacity, with simultaneously a compression-resistant surface which can be coated with mesh-reinforced exterior plaster to form a mesh-reinforced plaster layer 18. On the heat insulation panel 13 on the peripheral, face is provided a groove 21 in which a support rail 23 is held. This leads to a stable groove 21 which does not tear under load. The heat insulation panel 13 is provided with a back-cut 24 lying against the support rail 23. Thus a complete coverage of the support rail 23 by the heat insulation panel 13 can be achieved. The application of a reinforcement and/or a final coating is therefore substantially simplified.

The support rail 23 preferably has the shape of a T-profile and is made of polypropylene, hard PVC, aluminium or another suitable material. The T-profile 23 has a web 25 directed towards the outer wall and two retaining extensions 27*a*, 27*b* extending parallel to the surface of the insulation layer on both sides of the web 25. The retaining extensions 27*a*, 27*b* are held by form fit in the grooves 21. The support rail 23 is fastened horizontally to the outer wall 19. In order for the retaining extensions 27*a*, 27*b* to align with the groove 21, the support rail 23 is spaced from the outer wall 19 by means of at least two spacers 29. The spacers 29 preferably have the shape of flat bar 29. On its side facing the support rail, it is connected to this for example by screw connection. On its side facing the outer wall 19, on the flat bar 29 is provided a slot 31 which extends in the longitudinal direction of the bar 29. By means of a further connection for example also by screw connection, the flat bar 29 is fixed to an angle bracket 33. The angle bracket 33 can be designed for fixing a single flat bar 29 with a width which is slightly greater than the flat bar 29. It is also possible for the angle bracket 33 to be designed as an angle rail to which a multiplicity of flat bars is fixed. The angle bracket 33 in turn is fixed to the outer wall 19 by means of screw pegs or nail pegs.

The spacing of the retaining extensions 27*a*, 27*b* from the outer wall 19 must correspond to the spacing of the groove 21 from the outer wall else the heat insulation panels 13 cannot be pushed onto the support rail 23. To maintain the predefined spacing of the grooves 21 precisely, flat bars 29 of different lengths can be used. The fine adjustment is achieved in that the flat bar 23 can slide along the slot 31 relative to the angle bracket 33. It is also conceivable that the slot 31 is provided on the angle bracket 33 and merely a circular passage opening is provided on the flat bar 29.

To prevent bending of the flat rods 29 under the weight of the heat insulation panels 11, the support rail is also held on the outer wall by means of at least two tension brackets 35. The tension brackets 35 are held in the separating joints 30 of two adjacent heat insulation panels. For flexible mounting of the tension brackets 35, longitudinal passage openings 37 are provided at regular intervals in the web 25. The first end of the tension bracket 35 is formed as a hook 39. The tension bracket 35 can be mounted simply and quickly on the support rail 23 as the hook need merely be guided through one of the passage openings 37. The second end of the tension bracket is formed as a mounting ring 41. This serves for fixing the tension bracket 35 to the outer wall 19, for example with screw pegs. With this form of fixing of the heat insulation panels 13, practically no shear forces act within the heat insulation panels. The inner heat insulation panel 17 can therefore, as already described, be designed very lightweight since no loads act on this because of the wall fixing.

The heat insulation panels 13 and the inner heat insulation panels 17 are mounted on the outer wall as follows:

On the lower edge of the outer wall 19, the angle brackets or angle rails 33 are fixed by means of screw pegs. Then the flat rods 29, whose length correlates with the thickness of the heat insulation panels used, are screwed to the angle brackets 33. The number of angle brackets 33 or the flat rods 29 is dimensioned such that the weight of the insulation panels 13, 17 is supported reliably. On the flat rods 29 are attached a plurality of support rails 23 in succession so that these extend over the entire length of the outer wall 19 to be insulated. The support rails 23 of the bottom row can also be L-shaped instead of T-shaped as only the retaining extension 27*a* serves to hold insulation panels 13. Starting from one side of the outer wall 19, the inner heat insulation panel 17 is arranged on the flat bars 29 below it and the heat insulation panel 13 is pushed with groove 21 onto the upper retaining extension 27*a*. Then a first tension bracket 35 is inserted in a longitudinal passage opening 37 with the hook 39 parallel to support rail 23. The passage opening 37 is selected which lies closest to the side wall 43 of the heat insulation panel. Then the tension bracket is twisted through 90° about its longitudinal axis and the mounting ring guided onto the outer wall. In this position the tension bracket 35 is fixed to the support rail 23 and lies against the facing side wall 43 of the heat insulation panel. The tension bracket 35 is attached to the outer wall 19 by means of a screw peg. Optionally now a spring 28 can be inserted in the vertical groove 21. The spring 28 corresponds in length to approximately the height of the heat insulation panel 13. By use of the additional spring 28, the heat insulation panels 13 are aligned flush to each other at their vertical joints. After the width of the outer wall 19 to be insulated has been covered with a first row of heat insulation panels 13, in the manner described a second row is attached to the outer wall. The retaining extensions 27*b* of the second support rail row then engage in the upper grooves 21 of the first heat insulation panel row below. Thus as many rows of heat insulation panels are attached as required to insulate the entire surface of the outer wall 19. The vertical separating joints 30 of two adjacent rows of heat insulation panels are arranged offset to each other. The row structure ensures that the holding construction of one row carries only the weight of one row of heat insulation panels.

To summarise, the following can be stated:

With the façade insulation 11 according to the invention, heat insulation panels 13 and inner heat insulation panels 17 are attached to an outer wall 19 of a building. The two heat insulation panels 13, 17 have different densities and thicknesses. On the high density heat insulation panels 13 facing away from the outer wall 19, a peripheral groove 21 is provided on their side faces. To attach the heat insulation panels 13, at least in the horizontal grooves 21 are received an upper retaining extension 27*a* of a support rail 23 which is arranged below the heat insulation panel 13, and a lower retaining extension 27*b* of a further support rail 23 which is arranged above the heat insulation panels 13. The support rails 23 are spaced from the outer wall 19 by spacers 29 in the form of flat rods. The spacers 29 are in turn attached to the outer wall 19 by means of angle brackets. In order for the retaining extensions 27*a*, 27*b* to lie precisely in the plane of the horizontal groove 21, spacers of corresponding lengths are used. Fine adjustment takes place by displacing the spacers 29 along slots 31 towards the outer wall or away from the outer wall. The slots 31 can be provided either on the angle brackets 33 or on the spacers 29. To avoid flexion of the spacers 29, the support rail 23 is also held by tension brackets 35 which are arranged in the vertical joints between two adjacent heat insulation panels.

LEGEND

11 Façade insulation
13 Higher density heat insulation panel
17 Lower density inner heat insulation panel
19 Outer wall of a building
21 Groove
23 Support rail
24 Back-cut

25 Web of support rail 23
27*a*, 27*b* Retaining extensions of support rail 23
28 Spring
29 Spacer in the form of a flat bar
30 Separating joint
31 Slot
33 Fixing element, angle bracket
35 Tension bracket
37 Passage opening for tension bracket fixing to support rail
39 Hook on tension bracket for fixing to support rail
41 Mounting ring of tension bracket
43 Side wall of heat insulation panel

The invention claimed is:

1. Façade insulation comprising:

at least one support rail arranged on an outer wall of a building, at least one longer tension bracket, and at least one shorter spacer which holds the at least one support rail on the outer wall, a multiplicity of first heat insulation panels arranged in front of the outer wall, a multiplicity of second heat insulation panels supported by the at least one support rail and spaced from the outer wall of the building, whereby between an inside of the multiplicity of second heat insulation panels and the outer wall is formed a cavity which receives the multiplicity of first heat insulation panels, and a third reinforced layer operatively disposed on an outer surface of the multiplicity of second heat insulation panels without a gap therebetween and such that the multiplicity of second heat insulation panels are interposed between the multiplicity of first heat insulation panels and the third reinforced layer, wherein the at least one longer tension bracket and the at least one shorter spacer are fixed to the at least one support rail, wherein the at least one longer tension bracket and the at least one shorter space are separate elements, wherein the at least one support rail has a web facing the outer wall and is fixed with this web to a first end of the at least one spacer, and wherein retaining extensions are provided on both sides of the web on which extensions the heat insulation panels are held by form fit, the at least one longer tension bracket and the at least one shorter spacer both being fixed to the web of the at least one support rail.

2. Façade insulation according to claim 1, wherein at least one of the second heat insulation panels has a density whose upper value is 190 kg/m$^3$, preferably 170 and particularly preferably 150 kg/m$^3$, and whose lower value is 100 kg/m$^3$, preferably 110 kg/m$^3$ and particularly preferably 120 kg/m$^3$.

3. Façade insulation according to claim 1, wherein at least one of the first inner heat insulation panels has a density whose upper value is 90 kg/m$^3$, preferably 70 and particularly preferably 65 kg/m$^3$, and whose lower value is 20 kg/m$^3$, preferably 30 kg/m$^3$ and particularly preferably 55 kg/m$^3$.

4. Façade insulation according to claim 1, wherein at least one of the first inner heat insulation panels has a greater thickness than at least one of the second heat insulation panels, wherein the thickness of the at least one first heat insulation panel is preferably at least 1.5 times the thickness of the at least one second heat insulation panel.

5. Façade insulation according to claim 1, wherein at least one of the first heat insulation panels is supported by the at least one spacer, and the multiplicity of first heat insulation panels fill the cavity between the outer wall and the multiplicity of second heat insulation panels.

6. Façade insulation according to claim 1, wherein each of the multiplicity of second heat insulation panels include grooves on a periphery which serve to receive retaining extensions of the at least one support rail.

7. Façade insulation according to claim 1, wherein a multiplicity of passage openings is provided at regular intervals on the web, the at least one longer tension bracket being fixed to the at least support rail via one of the passage openings.

8. Façade insulation according to claim 1, wherein the at least one tension bracket is suspended with a first end on the at least one support rail.

9. Façade insulation according to claim 1, wherein the at least one tension bracket is arranged in the vertical separating joints between two adjacent heat insulation panels.

10. Façade insulation according to claim 1, wherein the at least one spacer is fixed at one end to the outer wall with at least one fixing element.

11. Façade insulation according to claim 10, wherein slots which extend perpendicular to the outer wall are provided on the at least one spacer at a short distance from the ends or at the at least one fixing element.

12. Façade insulation according to claim 2, wherein at least one of the first inner heat insulation panels has a density whose upper value is 90 kg/m$^3$, preferably 70 and particularly preferably 65 kg/m$^3$, and whose lower value is 20 kg/m$^3$, preferably 30 kg/m$^3$ and particularly preferably 55 kg/m$^3$.

13. Façade insulation according to claim 2, wherein at least one of the first inner heat insulation panels has a greater thickness than at least one of the second heat insulation panels, wherein the thickness of the at least one of first heat insulation panel is preferably at least 1.5 times the thickness of the at least one of second heat insulation panel.

14. Façade insulation according to claim 3, wherein at least one of the first inner heat insulation panels has a greater thickness than at least one of the second heat insulation panels, wherein the thickness of the at least one of first heat insulation panel is preferably at least 1.5 times the thickness of the at least one of second heat insulation panel.

15. Façade insulation according to claim 1, wherein a multiplicity of passage openings is provided at regular intervals on the web, the at least one longer tension bracket being fixed to the at least support rail via one of the passage openings.

16. Façade insulation according to claim 6, wherein a multiplicity of passage openings is provided at regular intervals on the web, the at least one longer tension bracket being fixed to the at least support rail via one of the passage openings.

17. Façade insulation according to claim 1, wherein the at least one longer tension bracket has first and second ends, and wherein only one of the first and second ends of the at least one longer tension bracket is coupled to the at least one support rail.

18. Façade insulation according to claim 1, wherein an angle of attachment of the at least one longer tension bracket for the at least one support rail forms an acute angle.

19. Façade insulation according to claim 1, wherein the third reinforced layer comprises a mesh-reinforced layer.

* * * * *